US006688264B2

(12) United States Patent
Cristiani et al.

(10) Patent No.: US 6,688,264 B2
(45) Date of Patent: Feb. 10, 2004

(54) METHOD OF PILOTING ELECTROMAGNETIC ACTUATORS FOR THE CONTROL OF A PLURALITY OF VALVES OF AN ENGINE

(75) Inventors: Marcello Cristiani, Imola (IT); Gianni Padroni, Portoferraio (IT); Aurelio Rivizzigno, Bussoleno (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 0 days.

(21) Appl. No.: 10/065,135

(22) Filed: Sep. 19, 2002

(65) Prior Publication Data

US 2003/0056742 A1 Mar. 27, 2003

(30) Foreign Application Priority Data

Sep. 20, 2001 (IT) ..... BO2001A0569

(51) Int. Cl.[7] ..... F01L 9/04

(52) U.S. Cl. ..... 123/90.11; 123/90.15; 361/139; 361/144; 361/146; 251/129.01

(58) Field of Search ..... 123/90.11, 90.15; 361/154, 152, 159, 160, 166, 191, 194, 139–146; 251/129.01, 129.04, 129.09, 129.15, 129.2; 324/207.16; 318/135

(56) References Cited

U.S. PATENT DOCUMENTS 6,390,037 B2 * 5/2002 Di Lieto et al. ..... 123/90.11

FOREIGN PATENT DOCUMENTS

| | | |
|---|---|---|
| EP | 376715 | 7/1990 |
| EP | 1087110 | 3/2001 |
| JP | 09250318 | 9/1997 |

* cited by examiner

*Primary Examiner*—Thomas Denion
*Assistant Examiner*—Kyle Riddle
(74) *Attorney, Agent, or Firm*—Howrey Simon Arnold & White LLP

(57) ABSTRACT

Method for piloting electromagnetic actuators for the control of the valves of an engine; each electromagnetic actuator is provided with at least one respective electromagnet, which is piloted by a common piloting device by means of the supply of an electric current wave which has two, initial and end control portions in which the intensity of the electric current varies rapidly and an intermediate maintenance portion in which the intensity of the electric current remains substantially constant; the method consists of supplying respective electric current waves cyclically to the electromagnets in order to control the valves according to the drive point, and to vary at a control portion of each wave the value of the intensity of the electric current supplied during the portions of maintenance of the other waves in order to limit the variation of the quantity of electric charge distributed overall by the piloting device.

13 Claims, 2 Drawing Sheets

METHOD OF PILOTING ELECTROMAGNETIC ACTUATORS FOR THE CONTROL OF A PLURALITY OF VALVES OF AN ENGINE

BACKGROUND OF INVENTION

The present invention relates to a method for piloting electromagnetic actuators for the control of the valves of an engine.

As is known, internal combustion engines are currently at the experimental stage, in which the intake and discharge valves are moved by electromagnetic actuators (of the type described in European patent application EP1087110). These electromagnetic actuators have undoubted advantages, since they make it possible to control each valve according to an optimized law for any operative condition of the engine, whereas the conventional mechanical actuators (typically cam shafts) require definition of a raising profile of the valves which represents an acceptable compromise for all the possible operating conditions of the engine.

An electromagnetic actuator for a valve of an internal combustion engine of the above-described type normally comprises an actuator body, which is connected to the stem of the valve and in conditions of rest is maintained by at least one spring in an intermediate position between two de-excited electromagnets; in use, the electromagnets are controlled such as to exert alternately a force of attraction of magnetic origin on the actuator body in order to displace the actuator body itself between the two end stop positions, which correspond to a position of maximum opening and of closure of the respective valve.

The electromagnets of the electromagnetic actuators are piloted by a common piloting device, which is supplied by the electrical generation system of the vehicle, which normally consists of an electrolytic battery and a direct current generator which is connected mechanically to the drive shaft. In particular, each electromagnet is piloted by the common piloting device by means of the supply of an electric current wave which has two, initial and end control portions in which the intensity of the electric current varies rapidly and an intermediate maintenance portion in which the intensity of the electric current remains substantially constant and equal to a maintenance value; the control portions of an electric current wave are disposed at the start of the wave, when the electric current passes from the zero value to the maintenance value by means of a pulse which has a higher peak than the maintenance value, and at the end of the wave, when the electric current passes from the maintenance value to the zero value.

At each control portion, there is a pulse variation of the quantity of electric charge distributed overall by the piloting device which involves substantially identical pulse variation of the quantity of electric charge supplied to the piloting device by the electrical generation system of the vehicle; it has been observed that the generator cannot cope with this pulse variation of electric charge owing to the speed of this variation, which must be absorbed entirely by the battery.

However, it has been observed experimentally that a battery which is subjected continually to the above-described pulse variations of electric charge distributed deteriorates very quickly, and in practice has a service life which is no greater than 5–6 months, compared with a normal service life of at least 3–4 years.

In order to try to eliminate the above-described disadvantage, it has been proposed to place in parallel with the piloting device a capacitor bank, which can absorb the pulse variations of electric charge in place of the battery. However, in order to be efficient this solution requires the installation of very high overall capacities (indicatively between 3 and 8 mF), which require use of electrolytic capacitors which are costly, cumbersome, and relatively unreliable in a hostile environment such as the engine compartment.

SUMMARY OF INVENTION

The object of the present invention is to provide a method for piloting electromagnetic actuators for control of the valves of an engine, which is free from the above-described disadvantages and, in particular, is easy and economical to implement.

According to the present invention, a method for piloting electromagnetic actuators for control of the valves of an engine is provided; each electromagnetic actuator comprising at least one respective electromagnet, which is piloted by a common piloting device by means of supply of an electric current wave which has at least one control portion in which the intensity of the electric current varies rapidly and a maintenance portion in which the intensity of the electric current remains substantially constant; the method consisting of supplying respective electric current waves cyclically to the electromagnets in order to control the valves according to the drive point; the method being characterized in that at the control portion of each electric current wave there is variation of the value of the intensity of the electric current supplied during the portions of maintenance of the other electric current waves in order to limit the variation of the quantity of electric charge distributed overall by the piloting device.

BRIEF DESCRIPTION OF DRAWINGS

The present invention will now be described with reference to the attached drawings, which illustrate a non-limiting embodiment of it, in which.

DETAILED DESCRIPTION

Figure 1:
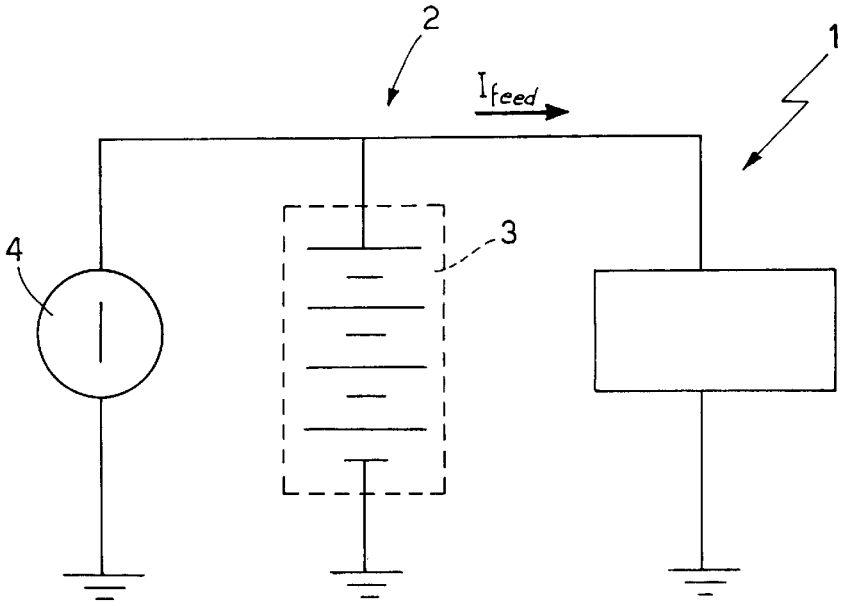
FIG. 1 is a schematic diagram of the electric supply circuit of an electromagnetic control system for the valves of an engine which operates according to the method which is the subject of the present invention.

In FIG. 1, 1 indicates as a whole an electromagnetic control system for the valves of an internal combustion engine (which is of a known type and is not illustrated); the electromagnetic system 1 receives an electric supply, i.e. a direct current $I_{feed}$ at a constant voltage of 12 V, from an electric circuit 2 which is connected to an electrolytic battery 3 of the engine, and to a direct current generator 4 of the engine.

Figure 2:
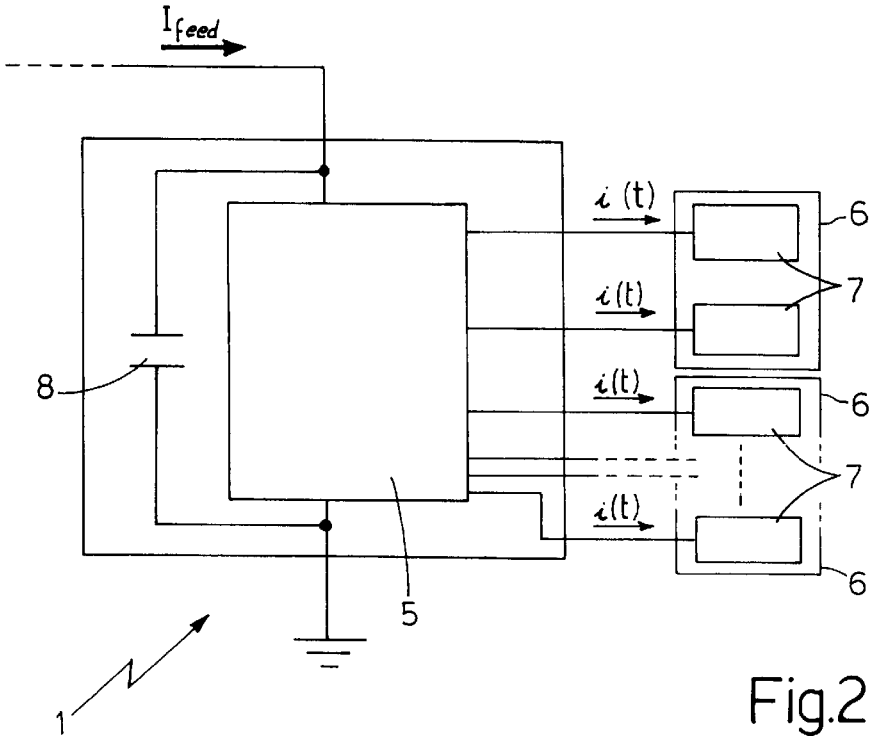
FIG. 2 illustrates in greater detail the electromagnetic control system for the valves in FIG. 1.

As illustrated in FIG. 2, the electromagnetic system 1 comprises a piloting device 5, which receives the current $I_{feed}$ from the electric circuit 2 and pilots a series of electromagnetic actuators of a known type (for example of the type described in patent application EP1087110). Each electromagnetic actuator 6 is connected to a respective valve (not illustrated) for intake or discharge of the engine in order to displace the valve itself along a longitudinal axis of the valve between a position of closure and a position of maximum opening. In particular, each electromagnetic actuator 6 comprises an oscillating arm (not illustrated) which is made at least partially of ferromagnetic material and is connected mechanically to the stem of the respective valve, and two electromagnets 7 which are disposed on opposite sides of the oscillating arm. In use, the piloting device 5 pilots the electromagnets 7 in order to exert alternately or simultaneously a force of attraction of magnetic origin on the oscillating arm (not illustrated) such as to displace the oscillating arm itself between two limit stop positions, which correspond to the said positions of maximum opening and closure of the respective valve (not illustrated).

Figure 3:
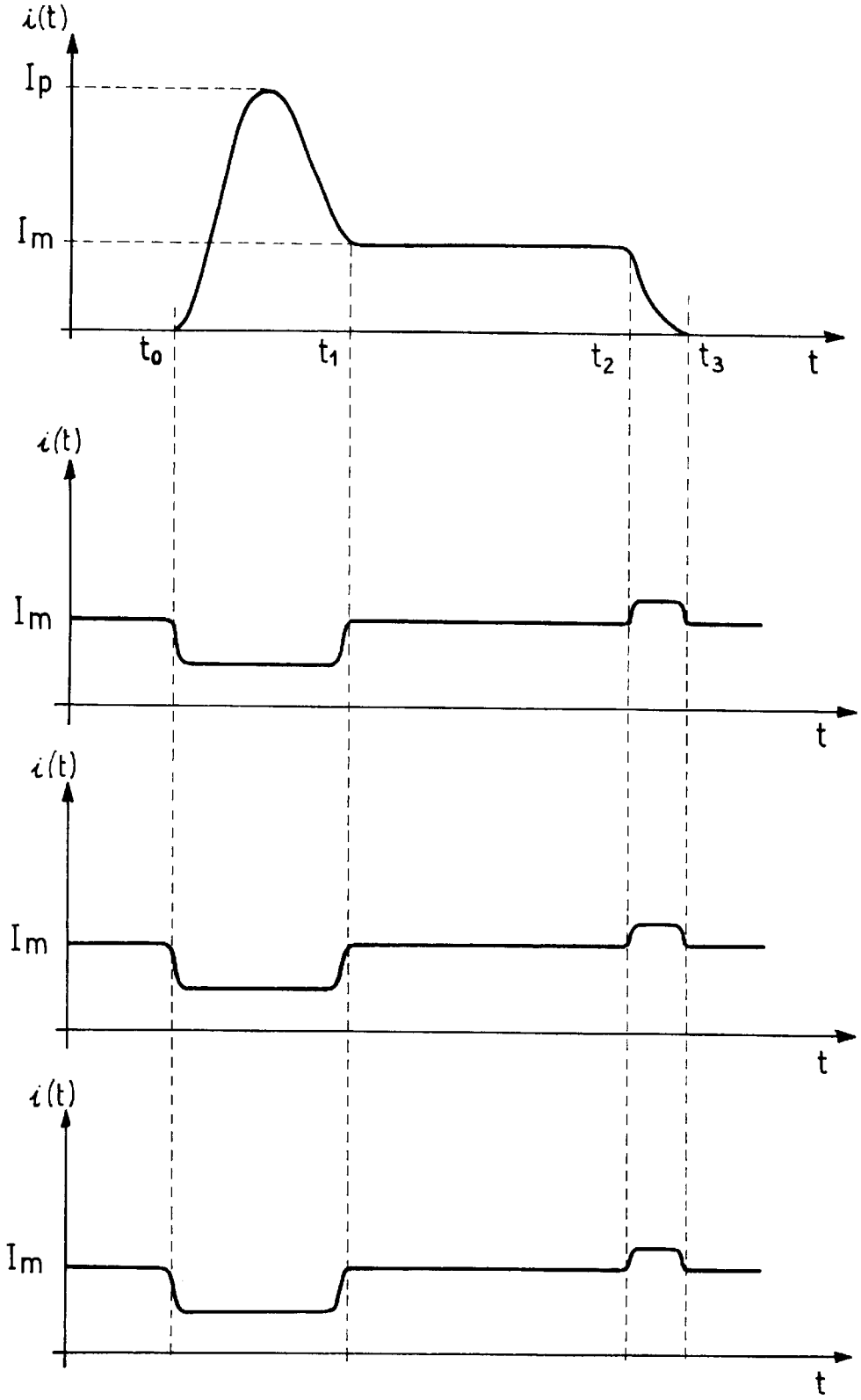
FIG. 3 is a graph of the temporal development of the piloting currents of the coils of some electromagnetic actuators of the electromagnetic system in FIG. 2.

Each electromagnet 7 of an electromagnetic actuator 6 is piloted by the piloting device 5 independently from the other electromagnet 7 with a respective electric current wave O, which is illustrated fully in the upper graph in FIG. 3 and has two end control portions in which the intensity of the electric current i(t) varies rapidly and an intermediate maintenance portion in which the intensity of the electric current i(t) remains substantially constant. In particular, each electric current wave O comprises an initial control portion (contained between the instants of time $t_0$ and $t_1$), during which the intensity of the electric current i(t) passes from the zero value to a maintenance value $I_m$ by means of a pulse which has a higher peak $I_p$ than the maintenance value $I_m$ itself, the intermediate maintenance portion (contained between the instants of time $t_1$ and $t_2$), during which the intensity of the electric current i(t) is maintained substantially constant and equal to the maintenance value $I_m$, and a final control portion (contained between the instants of time $t_2$ and $t_3$), during which the intensity of the electric current i(t) passes from the maintenance value $I_m$ to the zero value by means of a descent gradient.

In use, the piloting device 5 supplies respective electric current waves O cyclically to the electromagnets 7 of the electromagnetic actuators 6 in order to control the valves (not illustrated) according to the drive point; it is apparent that at a control portion of an electric current wave O, very rapid variation occurs of the quantity of electric charge distributed (and thus absorbed) overall by the piloting device 5.

As illustrated by way of example in FIG. 3, in order to compensate at least partially for this variation of the quantity of electric charge absorbed by the piloting device 5, the piloting device 5 itself varies according to the control portion of each electric current wave O the value of the intensity of the electric current i(t) supplied during the portions of maintenance of the other electric current waves O. In other words, at the initial control portion of each electric current wave O, there is a decrease in the value of the intensity of the electric current i(t) supplied during the portions of maintenance of the other electric current waves O, whereas at the final control portion of each electric current wave O, there is an increase in the value of the intensity of the electric current i(t) supplied during the portions of maintenance of the other electric current waves O.

It will be appreciated that the variation of the intensity of the electric current i(t) during the portions of maintenance of the other electric current waves O must be such as to generate variation of the quantity of electric charge which is substantially equal and contrary to the variation of the quantity of electric charge generated by the control portion.

According to a different embodiment, at the control portion of each electric current wave O, temporary use can also be made of the electromagnets 7 which are not active at that moment as accumulators or temporary restorers of electric energy.

It is important to observe that the temporary variation of the intensity of the electric current i(t) supplied during a maintenance portion to an electromagnet 7 must be such as not to interfere with the functionality of the electromagnet 7 itself; for this purpose the temporary variation of the intensity of the electric current i(t) supplied during a maintenance portion to an electromagnet 7 is always limited to within an interval of acceptability.

Normally, during a maintenance portion, the respective oscillating arm (not illustrated) abuts the corresponding electromagnet 7, and thus a temporary increase in the intensity of the electric current i(t) does not affect the functionality of the electromagnet 7 since it gives rise to an increase in the force of attraction which tends to stabilize further this stop condition. On the other hand, a temporary decrease in the intensity of the electric current i(t) could affect the functionality of the electromagnet 7 since it gives rise to a decrease in the force of attraction which could lead to detachment of the oscillating arm from the electromagnet. For this reason, at all times the intensity of the electric current i(t) supplied during a maintenance portion is maintained no lower than a minimum maintenance value, which is lower than the maintenance value $I_m$. By way of example, the maintenance value $I_m$ could be equal to approximately 5A, and the minimum maintenance value could be equal to approximately 3A.

The above-described operative method makes it possible to reduce substantially the value of the pulse variations of the quantity of charge distributed (and thus absorbed) by the piloting device 5; however, experimental tests have shown that it is extremely difficult to eliminate completely these pulse variations of the quantity of charge in all conditions and it is therefore preferable to connect in parallel to the piloting device 5 a capacitor 8 with a capacity (and therefore dimensions and cost) which is relatively reduced (lower than 500 $\mu$F).

It is apparent from the foregoing description that the above-described operative method makes it possible to prevent the battery 3 from having to withstand the pulse variations of the quantity of charge absorbed by the piloting device 5 simply and economically, since it does not require any variation of the structure of the electromagnetic system 1 and uses a capacitor 8 with a capacity (and thus dimensions and cost) which is relatively reduced.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. Method for piloting electromagnetic actuators (6) for the control of the valves of an engine; each electromagnetic actuator (6) comprising at least one respective electromagnet (7), which is piloted by a common piloting device (5) by means of the supply of an electric current wave (O) which has at least one control portion in which the intensity of the electric current (i) varies rapidly and a maintenance portion in which the intensity of the electric current (i) remains substantially constant; the method consisting of supplying respective electric current waves (O) cyclically to the electromagnets in order to control the valves according to the drive point; the method being characterized in that there is variation at the control portion of each electric current wave (O) of the value of the intensity of the electric current (i) supplied during the portions of maintenance of the other electric current waves (O) in order to limit the variation of the quantity of electric charge distributed overall by the piloting device (5).

2. Method according to claim 1, wherein each said electric current wave (O) has at least two, initial and end control portions in which the intensity of the electric current (i) varies rapidly respectively in increase and in decrease; the said maintenance portion being intermediate relative to the initial and end control portions; and variation taking place at the control portions of each electric current wave (O) of the value of the intensity of the electric current (i) supplied during the portions of maintenance of the other electric current waves (O) in order to limit the variation of the quantity of electric charge distributed overall by the piloting device (5).

3. Method according to claim 2, wherein during the said intermediate maintenance portion the electric current (i) is normally maintained equal to a maintenance value ($I_m$); during the said initial control portion the electric current (i) passing from the zero value to the maintenance value ($I_m$) by means of a pulse with a peak ($I_p$) which is higher than the maintenance value ($I_m$) itself; and during the said final control portion the electric current (i) passing from the maintenance value ($I_m$) to the zero value by means of a descent gradient.

4. Method according to claim 2, wherein during the initial control portion of each current wave (O) there is a decrease in the value of the intensity of the electric current (i) supplied during the portions of maintenance of the other electric current waves (O) in order to limit the variation of the quantity of electric charge distributed overall by the piloting device (5).

5. Method according to claim 2, wherein during the final control portion of each current wave (O) there is an increase in the value of the intensity of the electric current (i) supplied during the portions of maintenance of the other electric current waves (O) in order to limit the variation of the quantity of electric charge distributed overall by the piloting device (5).

6. Method according to claim 1, wherein the temporary variation of the intensity of the electric current (i) supplied during a maintenance portion is always limited to within an interval of acceptability.

7. Method according to claim 6, wherein during a said maintenance portion the value of the intensity of the electric current (i) supplied to the said electromagnet (7) is normally equal to a maintenance value ($I_m$); at all times the intensity of the electric current (i) supplied during a maintenance portion is maintained no lower than a minimum maintenance value, which is lower than the said maintenance value ($I_m$).

8. Method according to claim 7, wherein the said maintenance value ($I_m$) is equal to approximately 5A, and the said minimum maintenance value is equal to approximately 3A.

9. Method according to claim 1, wherein each said electromagnetic actuator (6) comprises a pair of electromagnets (7) and an actuator body, which is connected to the stem of the respective valve and is fitted such as to be mobile between the two electromagnets; the electromagnets (7) being piloted in order to exert alternately a force of attraction of magnetic origin on the actuator body in order to displace the actuator body itself between two end stop positions, which correspond to a position of maximum opening and of closure of the respective valve.

10. Method according to claim 9, wherein each said electromagnet (7) of an electromagnetic actuator (6) is piloted by the said piloting device (5) independently from the other electromagnet (7) with a respective said electric current wave (O).

11. Method according to claim 1, wherein at the control portion of each electric current wave (O) use is made of the electromagnets (7) which are not active at that moment as accumulators or temporary restorers of electric energy.

12. Electromagnetic system (1) for control of the valves of an internal combustion engine which operates according to the method provided in claim 1.

13. Method for piloting electromagnetic actuators (6) for the control of the valves of an engine; each electromagnetic actuator (6) comprising at least one respective electromagnet (7), which is piloted by a common piloting device (5) by means of the supply of an electric current wave (O) which has at least one control portion in which the intensity of the electric current (i) varies rapidly and a maintenance portion in which the intensity of the electric current (i) remains substantially constant; the method consisting of supplying respective electric current waves (O) cyclically to the electromagnets in order to control the valves according to the drive point; the method being characterized in that at the control portion of each electric current wave (O) use is made of the electromagnets (7) which are not active at that moment as accumulators or temporary restorers of electric energy in order to limit the variation of the quantity of electric charge distributed overall by the piloting device (5).

* * * * *